US005581858A

United States Patent [19]

Curran et al.

[11] Patent Number: 5,581,858

[45] Date of Patent: Dec. 10, 1996

[54] MAKING TEXTILE STRANDS

[75] Inventors: William W. Curran; John Aitken, both of Paisley, Great Britain

[73] Assignee: J & P Coats, Ltd., Glasgow, Great Britain

[21] Appl. No.: 424,360

[22] PCT Filed: Nov. 2, 1993

[86] PCT No.: PCT/GB93/02255

§ 371 Date: Aug. 3, 1995

§ 102(e) Date: Aug. 3, 1995

[87] PCT Pub. No.: WO94/10362

PCT Pub. Date: May 11, 1994

[30] Foreign Application Priority Data

Nov. 4, 1992 [GB] United Kingdom ..... 9223102

[51] Int. Cl.[6] ..... D02G 1/18

[52] U.S. Cl. ..... 28/258; 28/220

[58] Field of Search ..... 28/220, 258

[56] References Cited

U.S. PATENT DOCUMENTS

| | | | |
|---|---|---|---|
| 4,226,079 | 10/1980 | Mountney et al. | 28/220 X |
| 4,341,063 | 7/1982 | Southerlin et al. | 28/220 x |
| 4,497,099 | 2/1985 | Scott | 28/220 |
| 4,571,793 | 2/1986 | Price | 28/220 |
| 4,615,167 | 10/1986 | Greenberg | 28/220 X |
| 4,674,273 | 6/1987 | Clements et al. | 28/258 X |
| 4,835,956 | 6/1989 | Sasaki et al. | 28/220 X |

FOREIGN PATENT DOCUMENTS

| | | | |
|---|---|---|---|
| 0352376 | 1/1990 | European Pat. Off. | D02G 1/18 |
| 1660586B2 | 3/1971 | Germany | D01D 5/22 |
| 130865 | 5/1978 | Germany | D01D 5/22 |

*Primary Examiner*—John J. Calvert

*Attorney, Agent, or Firm*—Robert A. Felsman; Mark D. Perdue

[57] ABSTRACT

There is disclosed a method for making a textile strand comprising passing two filamentous strands together through a jet device which commingles filaments of the two strands and then subjecting the thus commingled strands to a drawing step in which at least one of the strands is drawn to a stable drawn state.

24 Claims, 1 Drawing Sheet

MAKING TEXTILE STRANDS

This invention relates to making textile strands.

FIELD OF THE INVENTION

EP-A-0 037 118 describes methods for making a bulky flat yarn comprising preparing at least two kinds of thermoplastic synthetic undrawn yarns having different natural draw ratios, simultaneously drawing these prepared yarns at a draw ratio which is equal to or larger than the smallest natural draw ratio of the yarns and releasing drawing tension in the yarns after they are drawn. The yarns are mixed by means of an interlacing nozzle before or after they are drawn. These operations, utilising differences in the elastic recovery of the constituent yarns rather than their shrinkage properties, produce a filament yarn having high bulk and resiliency, without any crimps.

In the article "Lufttexturierung: Produkte und Technologie" (Air texturing: Products and Technology), E. Kreuzer; Chemiefasern/Textilindustrie 35, 87 Jahrgang, October 1985, pages 674 to 678, the texturizing machine FK6T-80 is described, and the possibilities for arranging the machine components to perform different texturing operations explained.

EP-0 057 583 discloses a method for making a textile strand involving differentially overfeeding two separate filamentous strands to a jet device which commingles and interlaces and forms loops in the filaments of the strands and then subjecting the commingled strand to a heating step in which loops formed by the jet are pulled out and in so doing tighten any entanglements present as a result of the jet treatment and thus consolidate the strand. A "twistless" sewing thread can be produced in this way, "twistless" implying not that the thread is without twist, because twist can always be added, but rather that the thread has been produced without the need for twisting which is implicit in the production of sewing thread from staple fibre such as cotton.

The method of EP-0 057 583 is capable of modification to vary the properties of the strand produced and, especially when sewing thread is being produced, can be adapted to produce a more or less "loopy" thread. It is sometimes suggested that the presence of loops in the thread can assist cooling of a sewing machine needle.

All modifications which have been suggested to the fundamental methods of EP-0 057 583 have, however, not resulted in a more economical production of a sewing thread, nor, indeed, could any more economical production be envisioned, since the method itself eliminates the major cost component of the production of conventional sewing thread, namely the twisting step or steps involved in consolidating the staple fibres into a coherent yarn.

The present invention provides methods for making a textile strand which, while maintaining the flexibility of the method of EP-0 057 583 for the production of different specifications of strand, especially in the context of sewing thread, gives, at the same time, the possibility of substantial cost reductions in the process.

SUMMARY OF THE INVENTION

The invention comprises a method for making a textile strand comprising passing two filamentous strands together through a jet device which commingles filaments of the two strands and then subjecting the thus commingled strands to a drawing step in which at least one of the strands is drawn to a stable drawn state.

The strands may be dissimilar.

The strands may be dissimilar in the extent to which they can be drawn. They may be partially drawn before the jet, and they may have been differentially overfed to the jet.

One strand may be overfed to the jet. Typical overfeeds may be 40% to 60%, but smaller and larger overfeeds may be useful in different circumstances.

The strands may be of the same polymer material, and will usually be multifilament strands, but three or more strands may be used, and one such may be a monofilament or a low filament count strand. Staple fibre strand may also be incorporated.

The commingled, drawn strand may be subjected to a heating step—the heating step may be at a temperature at which shrinkage (or more shrinkage would take place were the strand not held to length or permitted to contract by only a limited amount. A higher temperature may be employed to yield higher tenacity in the finished thread.

The invention also comprises a textile strand made by a process as disclosed, and such strand may comprise a sewing thread.

BRIEF DESCRIPTION OF THE DRAWINGS

Methods for making textile strands according to the invention will now be described with reference to the accompanying drawings, in which.

DETAILED DESCRIPTION OF THE INVENTION

Figure 1:
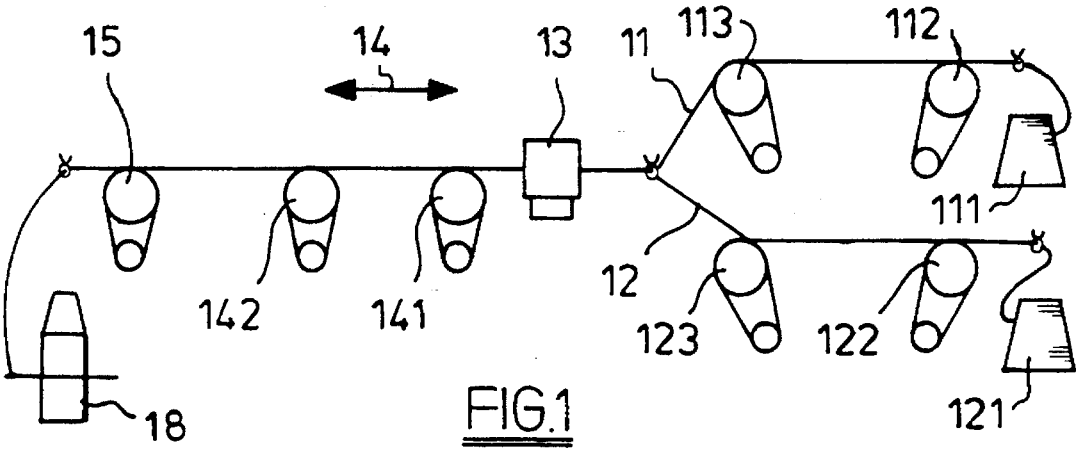
FIG. 1 is a diagrammatic illustration of one method.
Figure 2:
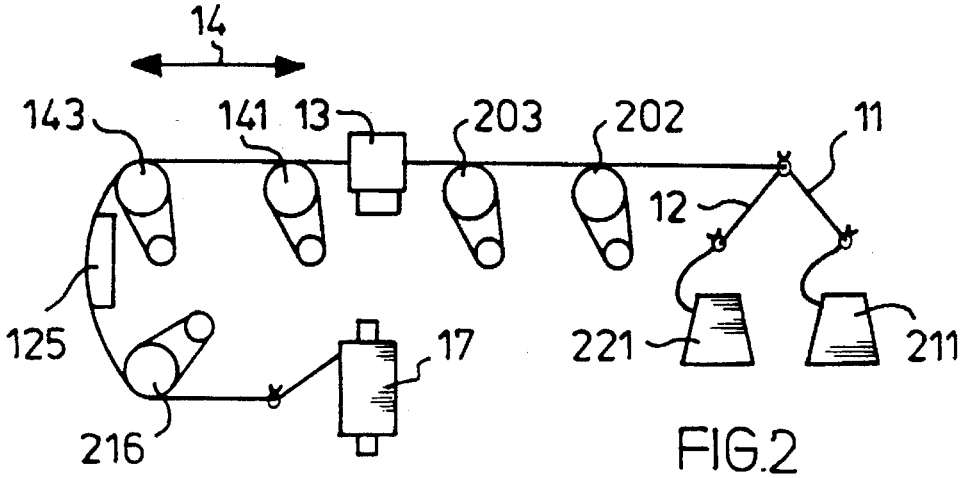
FIG. 2 is a diagrammatic illustration of another method.

The methods illustrated in FIGS. 1 and 2 comprise passing two dissimilar filamentous strands 11,12 together through a jet device 13 which commingles and forms loops in the filaments of the two strands 11,12 and then subjecting the thus commingled strands to a drawing step 14 in which at least one of the strands is drawn to a stable drawn state.

By "stable drawn state" is meant a state in which, at the temperature at which a finished product will be used—in the case of ordinary textile strands, such for example as those used as sewing threads, this will of course be room temperature and probably extend up to normal laundering, cleaning and pressing temperatures—the strand will extend under tension elastically, at least initially, rather than inelastically (with plastic or drawing extension).

If the strands are of different weights, one, perhaps, constituting a core or load-bearing strand, the other being an effect or binding strand—it will usually be preferred that the heavier or core strand is drawn to the stable drawn state.

The strands 11,12 may be dissimilar in the extent to which they can be drawn.

FIG. 1 illustrates a method in which strands 11,12 start out (or at least may start out) as similar strands supplied on packages 111,121, both, perhaps, being of POY. The two strands as supplied from packages 111,121 are drawn by differential speed godets 112,113; 122,123. The draw ratios achieved by godet pairs 112, 113;122,123 may each be substantially less than the full extent to which it is possible to draw the strands. Strand 11 may be drawn with a ratio 1.84:1, strand 12 with a ratio 1.78:1. Godet 123 may be arranged to rotate faster, by, say, 40% or 60% or even more, than godet 113 so as to overfeed strand 12 to the jet 13, by more than strand 11 is overfed thereto. The commingled strand is further drawn in the drawing stage 14 at a ratio 1.27:1.

The drawing stage 14 comprises input godet 141, and output hot godet 142. The drawn strand from godet 142 is then overfed 2½%–4% to a further godet 15. The thus hot relaxed strand is wound up.

In the method of EP-0 057 583 the speed at which the strand is wound up depends upon the rate at which the jet can handle the strands. In the present method, the strands are subject to a further drawing stage after the jet. In the method of FIG. 1 this drawing stage is carried out at a draw ratio of 1.27:1. The finished strand is thus wound up some 27% faster than is possible in the method as described in EP-0 057 583.

FIG. 2 illustrates a method in which dissimilar starting materials are used as strands 11,12, supplied from packages 211,221 and fed together to a drawing stage between godets 202,203. The strands 11,12 are dissimilar at least in regard to the extent to which they can be drawn. The partially drawn strand combination 11,12 is overfed to the jet 13 where the filaments of the strands 11,12 are commingled.

The commingled strand is drawn in the drawing stage 14 and when it leaves that stage the filaments contributed by strands 11,12 will have differential shrinkage because one of the strands will have been drawn to a lesser proportion of its possible draw ratio than the other. The drawn strand from the drawing stage 14 comprising input and output godets 141, 143 is subjected to a heating step by plate heater 215 while being held to length or allowed to have controlled shrinkage (or even, perhaps, stretched a little more) by a further godet roll 216 from where it is forwarded to a wind-up package 17.

Figure 3:
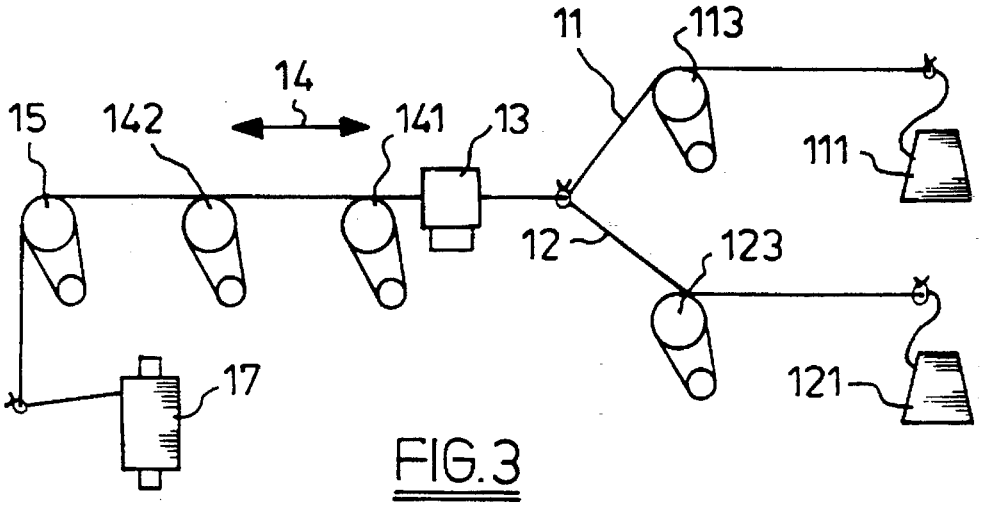
FIG. 3 is a diagrammatic illustration of yet another method.

FIG. 3 illustrates a method generally like that illustrated in FIG. 1 but in which no drawing takes place before the jet. Strands 11 and 12 both of POY but with strand 11 used as an effect yarn of lower dtex than strand 12 are overfed to a drawing stage 14 by feed rollers 113,123. Feed roller 113, as before, overfeeds by 40% (or more or less) with respect to the first-encountered roller 141 of the drawing stage 14, while feed roller 123 overfeeds by, say, 4.5% relative to that same roller 141. The commingled strands from the jet 13 are then drawn to the normal extent to which such yarns are hot drawn, or even overdrawn, in the drawing stage 14 and subsequently subjected to hot relaxation between the hot godet 142 and a godet 15 as before.

It will be noted that in the method of FIG. 1, the wind-up arrangement 18 is overend, as by a ring and traveller, while in FIGS. 2 and 3 a side wind-up 17 is illustrated. The thread wound up in the method of FIG. 1 will have some twist inserted during winding. Twist may be desirable for certain end uses, although for sewing thread, for example, the amount of twist which may be inserted to improve the sewing properties over the thread as produced without twist will be very substantially less than the twist required to make thread from staple fibres. The cost of manufacture of sewing thread can then be very much reduced by processes according to the present invention where twist is not required, or is not required to anything like the same extent.

When a side wind-up is used, any desired amount of twist may be inserted in a subsequent operation.

Consolidation of the thread is effected, or at least assisted, by the commingling effect of the jet 13 and the subsequent tightening brought about by the processes after the jet.

The methods described are particularly advantageous over other methods of producing coherent twist-free or low-twist strands in which drawing is effected completely before a jet commingling device inasmuch as the throughput of such methods is limited by the jet. With the present methods, a substantial proportion or indeed all of the draw is effected after the jet and this in effect means that the strand is produced correspondingly faster.

On the other hand, even delaying a small proportion of the draw until after commingling in the jet can have beneficial effects, producing a finer strand which has a higher tenacity (by as much as 10%) than if all the drawing is effected before the jet. At the same time any tendency to individual filament breakage on drawing before the jet is reduced and the resulting strand is noticeably smoother.

Many variations can be played on the basic method as defined above and described with reference to the drawings. For example, hot drawpin or a plate heater may be used for hot drawing instead of the hot roller as described; cold drawing may be appropriate in some circumstances.

And the possibility of filament breakage may itself be turned to good effect by inducing filament breakage after the jet to produce a thread with controlled filament breakage which would more resemble a spun thread.

We claim:

1. A method for making a coherent twist-free or low-twist textile strand, the method comprising the steps of:

passing a plurality of incompletely drawn filamentous strands together through a jet device to commingle filaments of the strands and forms loops therein, the strands being drawable; then drawing at least one of the filamentous strands to a stable drawn state, wherein the loops formed by the jet are pulled out and the textile strand is consolidated.

2. The method according to claim 1, in which the filamentous strands are dissimilar in the extent to which they can be drawn.

3. The method according to claim 1, in which the filamentous strands are partially drawn before passing through the jet device.

4. The method according to claim 1, in which the filamentous strands are differentially overfed to the jet device.

5. The method according to claim 1, in which one filamentous strand is overfed by up to 40% to the jet.

6. The method according to claim 1, in which the strands are of the same polymer material.

7. The method according to claim 1, in which the strands are both multifilament strands.

8. A method according to claim 1, in which the commingled, drawn strand is subjected to a heating step.

9. A process for making a coherent twist-free or low-twist textile strand, the comprising the steps of:

passing at least two separate filamentous strands together through a jet device which commingles filaments of the strands and thereby forms a commingled strand;

overfeeding at least one of the strands into the jet device wherein the jet device forms loops in the filaments of at least one strand and entanglements to form a bulky commingled strand;

drawing the bulky commingled strands, strands being heated during the drawing step, wherein the bulky commingled strand is consolidated by tightening and pulling out the loops and entanglements formed by the jet device.

10. The process according to claim 9, in which the filamentous strands are dissimilar in the extent to which they can be drawn.

11. The process according to claim 9, in which the filamentous strands are partially drawn before passing through the jet device.

12. The process according to claim 9, in which the filamentous strands are differentially overfed to the jet device.

13. The process according to claims 9, in which one filamentous strand is overfed by up to 40% to the jet.

14. The process according to claim 9, in which the strands are of the same polymer material.

15. The process according to claim 9, in which the strands are both multifilament strands.

16. A method according to claim 9, in which the commingled, drawn strand is subjected to a heating step.

17. A process for making a coherent twist-free or low-twist textile strand, the comprising the steps of:

passing at least two separate filamentous strands together through a jet device which commingles filaments of the strands and thereby forms a commingled strand;

the strands being overfed into the jet device whereby the jet device forms loops in the filaments of at least one strand and entanglements to form a bulky commingled strand;

the separate strands being drawable and at least one of them being overdrawn during the process;

at least the overdrawn strand being heat treated during the process;

the bulky commingled strand being drawable after leaving the jet device and being treated after the jet device to complete the drawing process wherein the strand is consolidated by tightening brought about thereby and loops formed by the jet device are pulled out and entanglements formed by the jet device are tightened.

18. The process according to claim 17, in which the filamentous strands are dissimilar in the extent to which they can be drawn.

19. The process according to claim 17, in which the filamentous strands are partially drawn before passing through the jet device.

20. The process according to claim 17, in which the filamentous strands are differentially overfed to the jet device.

21. The process according to claims 17, in which one filamentous strand is overfed by up to 40% to the jet.

22. The process according to claim 17, in which the strands are of the same polymer material.

23. The process according to claim 17, in which the strands are both multifilament strands.

24. A method according to claim 17, in which the commingled, drawn strand is subjected to a heating step.

* * * * *